US005535676A

United States Patent [19]

Buschulte et al.

[11] Patent Number: 5,535,676

[45] Date of Patent: Jul. 16, 1996

[54] APPARATUS FOR PROTECTING THE SURFACE OF FRESHLY PRINTED SHEETS

[75] Inventors: Rainer Buschulte, Bad Schönboro; Jürgen Kern, Mauer; Ralf Sammeck, Heidelberg, all of Germany

[73] Assignee: Heidelberger Druckmaschinen AG, Heidelberg, Germany

[21] Appl. No.: 350,612

[22] Filed: Dec. 7, 1994

[30] Foreign Application Priority Data

Dec. 7, 1993 [DE] Germany ..... 43 41 566.0

[51] Int. Cl.[6] ..... B41F 35/00

[52] U.S. Cl. ..... 101/424.2; 101/416.1

[58] Field of Search ..... 101/424.2, 424.1, 101/416.1, 488, 487, 483, 419, 420

[56] References Cited

U.S. PATENT DOCUMENTS

| | | | |
|---|---|---|---|
| 2,093,995 | 9/1937 | Blow | 101/424.2 |
| 2,110,052 | 3/1938 | Paasche | 101/424.2 |
| 3,740,248 | 6/1973 | Buhler | 428/403 |
| 3,861,351 | 1/1975 | Bonwit et al. | 101/424.2 |
| 4,033,263 | 7/1977 | Richmond | 101/424.1 |
| 4,393,773 | 7/1983 | Theilacker | 101/232 |
| 4,458,626 | 7/1984 | Dessilani | 118/315 |
| 4,807,528 | 2/1989 | Schmoeger et al. | 101/424.2 |
| 4,952,267 | 8/1990 | McPherson et al. | 156/291 |
| 5,062,919 | 11/1991 | McPherson et al. | 156/356 |
| 5,090,626 | 2/1992 | Platsch | 239/654 |

FOREIGN PATENT DOCUMENTS

| | | |
|---|---|---|
| 0436546 | 10/1993 | European Pat. Off. . |
| 203241 | 1/1906 | Germany . |
| 195362 | 6/1906 | Germany . |
| 378050 | 7/1923 | Germany . |
| 720616 | 4/1942 | Germany . |
| 1181244 | 11/1964 | Germany . |
| 1252703 | 5/1968 | Germany . |
| 2254405 | 5/1974 | Germany . |
| 1949039 | 1/1977 | Germany . |
| 2535587 | 2/1977 | Germany . |
| 2164296 | 9/1977 | Germany . |
| 2743828 | 2/1979 | Germany . |
| 3114076 | 11/1982 | Germany . |
| 3241127 | 5/1983 | Germany . |
| 3819203 | 12/1989 | Germany . |
| 3740046 | 1/1992 | Germany . |
| 4211401 | 10/1993 | Germany . |
| 1100725 | 1/1968 | United Kingdom . |
| 1243403 | 8/1971 | United Kingdom . |
| 2004773 | 9/1978 | United Kingdom . |

OTHER PUBLICATIONS

Druckindustrie Publication No. 21 (Walenski), Oct. 3, 1993, "Die Bestäubung im Offsetdruck".

ICI Publication 1990, 5 pages "Biological Products" .

*Primary Examiner*—Edgar S. Burr

*Assistant Examiner*—Anthony H. Nguyen

*Attorney, Agent, or Firm*—Herbert L. Lerner; Laurence A. Greenberg

[57] ABSTRACT

Apparatus for protecting the surface of freshly printed sheets which are deposited upon one another to form a sheet pile includes an applicator for applying to the respective sheets a separating-agent layer formed of solid particles of separating agent, the layer of separating agent being formed of a mixture including at least one degradable separating agent substance, an aqueous vehicle liquid, and at least one mixture component which degrades the separating agent substance upon simultaneous contact with the separating agent substance and the vehicle liquid.

15 Claims, 4 Drawing Sheets

APPARATUS FOR PROTECTING THE SURFACE OF FRESHLY PRINTED SHEETS

BACKGROUND OF THE INVENTION

FIELD OF THE INVENTION

The invention relates to an apparatus for protecting the surface of freshly printed sheets, which are deposited stacked on one another to form a sheet pile, the respective sheets having applied thereto by an applicator a separating-agent layer formed of solid particles of separating agent.

Heretofore known apparatuses of this general type, such as a dust applicator device in accordance with the German Patent Document DE 38 19 203 A1, blow separating-agent particles in the form of a powder onto a freshly printed surface of a respective sheet with the aid of compressed air.

As indispensible as a layer of separating agent formed by a powder often is, it can, nevertheless, have a deleterious effect on a final product passing through a printing process. One example is the urgent recommendation that powdered printed products be sanitized before being lined with foil. Any possible scratches in the printed image, for example, caused by joggers in delivery pile apparatuses in cooperation with the powder, remain irreparable.

Types of powder that are supposed to come loose under the influence of the moisture of the printing ink have indeed already been offered. However, tests have demonstrated, for example, in W. Walenski, "Die Bestäubung im Offsetdruck" (Powder Application in Offset Printing), Z. Druckindustrie (Printing Industry Journal), No. 21, Oct. 3, 1993, pp. 21–24, that suitable loosening does not occur even after what must certainly be called an adequate length of time.

SUMMARY OF THE INVENTION

Proceeding from this state of the prior art, it is an object of the invention to provide an apparatus for protecting the surface of freshly printed sheets, with which an initially adequately effective layer of separating agent can be produced in such a manner that in practical use it undergoes a structural change in the sense of a decreasing layer thickness.

With the foregoing and other objects in view, there is provided, in accordance with the invention, an apparatus for protecting the surface of freshly printed sheets which are deposited upon one another to form a sheet pile, comprising an applicator for applying to the respective sheets a separating-agent layer formed of solid particles of separating agent, the layer of separating agent being formed of a mixture including at least one degradable separating agent substance, an aqueous vehicle liquid, and at least one mixture component which degrades the separating agent substance upon simultaneous contact with the separating agent substance and the vehicle liquid.

In accordance with another feature of the invention, the mixture is formed of a natural thermoplastic substance which is degradable under the influence of microorganisms, and the microorganisms.

In accordance with another feature of the invention, the mixture includes a mixture component belonging to the substance group of polypeptides.

In accordance with a further feature of the invention, the vehicle liquid is a nutrient solution inoculated with bacteria.

In accordance with an added feature of the invention, the vehicle liquid includes a degrading mixture component in the form of a solvent which dissolves the separating agent substance.

In accordance with an additional feature of the invention, the mixture of the separating agent layer comprises a mixture of separating-agent particles moistened with the vehicle liquid, and first separating agent particles of the mixture of separating-agent particles are formed of the separating agent substance, and second separating agent particles of the mixture of separating-agent particles are formed of the degrading mixture component.

In accordance with an alternative feature of the invention, the mixture of the separating agent layer is formed from mixed particles moistened with the vehicle liquid, and the mixed particles have a core formed of the separating agent substance and a sheath surrounding the core and formed of the degrading mixture component.

In accordance with yet another feature of the invention, the separating agent particles are formed as microcapsules, respectively, having a capsule envelope formed of the separating agent substance, the capsule envelopes, respectively, being filled with a fractional amount of the vehicle liquid, the vehicle liquid being mixed with at least one degrading mixture component having degrading action reinforceable by energetic irradiation of the degrading mixture component, and the microcapsules being exposed to the energetic irradiation during the application of the separating agent layer to the respective sheets.

In accordance with yet a further feature of the invention, the separating agent particles are formed as microcapsules, and the microcapsules, respectively, have a capsule envelope formed of the separating agent substance, the capsule envelopes, respectively, being filled with a fluid which is free of a degrading mixture component and, during the application of the separating agent layer to the respective sheets, the microcapsules being exposed to moistening by means of the vehicle liquid mixed with at least one degrading mixture component.

In accordance with an alternative feature of the invention, the separating agent particles include first separating agent particles in the form of a granulate of a first separating agent substance and second separating agent particles in the form of microcapsules; the microcapsules, respectively, having a capsule envelope filled with a fractional amount of the vehicle liquid and formed of a second separating agent substance; the fractional amounts of vehicle liquid being mixed with at least one degrading mixture component; the at least one degrading mixture component and the first and the second separating agent substances being adapted to one another so that only the first separating agent substance is degradable by means of the at least one degrading mixture component; and including means for exposing the layer of separating agent at least temporarily to an external force which bursts the microcapsules.

In accordance with yet an added feature of the invention, the applicator has first spray nozzles for applying the mixture-forming separating agent particles, and second spray nozzles for applying a moistening agent for moistening the separating agent particles.

In accordance with yet an additional feature of the invention, the applicator includes a support roller rotatable in a first rotational direction during operation, and a contact roller rotatable during operation in a second direction of rotation opposite the first rotational direction, the support roller and the contact roller being positioned against one another in a contact zone and, respectively, contacting one side of a respective sheet passing through the contact zone in a sheet travel direction; the first spray nozzles, on the one hand, and the second spray nozzles, on the other hand, being directed towards a common target area on one side of the respective sheet, the target area being located before the contact zone in the sheet travel direction.

In accordance with one alternative feature of the invention, the applicator includes a support roller rotatable in a first rotational direction during operation, and an applicator roller rotatable during operation in a second direction of rotation opposite the first rotational direction, the support roller and the applicator roller being positioned against one another in a contact zone and, respectively, contacting one side of a respective sheet in the contact zone; the first spray nozzles, on the one hand, and the second spray nozzles, on the other hand, being directed towards a common target area on a free region of a jacket face of the applicator roller.

In accordance with another alternative feature of the invention, the applicator has a support roller rotatable in a first direction of rotation during operation and a pair of rollers, respectively, extending parallel to the support roller, positioned against or in engagement with one another and rotatable in opposite directions during operation; one roller of the pair of rollers being positioned against the support roller and having a second direction of rotation opposite that of the first direction of rotation; the support roller and the one roller of the pair of rollers which is positioned against the support roller, respectively, contacting one side of a respective sheet; the first spray nozzles, on the one hand, and the second spray nozzles, on the other hand, being directed towards a common target area on a free region of a jacket face of one of the rollers of the pair of rollers.

In accordance with another aspect of the invention, there is provided an apparatus for protecting the surface of freshly printed sheets which are deposited upon one another to form a sheet pile, comprising an applicator for applying to the respective sheets a separating-agent layer formed of solid particles of separating agent, the layer of separating agent being formed of a mixture of substances having the separating agent particles in the form of microcapsules; the microcapsules, respectively, having a colorless capsule envelope formed of a polypeptide and filled with a colorless fluid which is inert with respect to the polypeptide.

The objective of the invention of the instant application is thus attained by two different embodiments; in a first embodiment, an apparatus of the foregoing general type is distinguished by the fact that the layer of separating agent is formed of a mixture which has at least one degradable separating agent substance, an aqueous vehicle liquid, and at least one mixture component which degrades the separating agent substance upon simultaneous contact with the separating agent substance and the vehicle liquid, and in a second embodiment, an apparatus of the foregoing general type is distinguished by the fact that the separating agent layer is formed of a substance mixture having the separating agent particles in the form of microcapsules; the respective microcapsules having a colorless capsule envelope of a polypeptide and being filled with a colorless fluid which is inert with respect to the polypeptide.

The decrease in layer thickness in the case of the first embodiment occurs due to the degradation of the separating agent substance, so that after it has fully broken down, the initially fully effective layer of separating agent has entirely disappeared.

In practical use, the layer of separating agent present between adjacent sheets of a sheet pile is exposed to the weight of all the sheets resting on top of it, so that in the second embodiment, the particles of separating agent, in the form of microcapsules, burst under this weight, at least in a lower region of the pile. The same effect can be attained for an upper region of the sheet pile by turning the pile over. If a basic wall thickness of the capsule envelopes of these microcapsules is in the order of magnitude of approximately 0.1 to 0.5 μm, compared with a diameter of the microcapsules in the order of magnitude of up to approximately 300 μm, the effect even in the case of the second embodiment, in practical use, is a marked reduction in an initially adequately effective layer thickness of the separating agent layer.

In a preferred form of the first embodiment of the invention, the mixture is made up of a natural thermoplastic substance which is degradable under the influence of microorganisms, and the aforementioned microorganisms themselves.

A further preferred feature of the aforementioned first embodiment of the invention is that the mixture includes a mixture component belonging to the substance group of polypeptides, and includes a mixture component belonging to the substance group of peptide hydrolases. Gelatin, for example, is preferable as the polypeptide.

A further preferred feature of the aforementioned first embodiment is that the vehicle liquid is a nutrient solution inoculated with bacteria.

In a further preferred feature of the aforementioned first embodiment, the vehicle liquid includes a degrading mixture component in the form of a solvent which dissolves the separating agent substance.

With respect to the structural makeup of a separating agent layer according to the invention, the degrading mixture is formed of a mixture of separating agent particles moistened with the vehicle liquid, and first separating agent particles of the moistened particle mixture are formed of the separating agent substance, and second separating agent particles of the moistened particle mixture are formed of the degrading mixture component.

In a further feature, in terms of the structural makeup of a separating agent layer according to the invention, the mixture is formed from mixed particles moistened with the vehicle liquid, and the mixed particles, respectively, have a core formed of the separating agent substance and a sheath surrounding the core and formed of the degrading mixture component.

Another preferred feature of the structural makeup of a separating agent layer according to the invention is that the separating agent particles are in the form of microcapsules, and the microcapsules, respectively, have a capsule envelope formed of the separating agent substance, the capsule envelopes, respectively, being filled with a fractional amount of the vehicle liquid, which is mixed with at least one degrading mixture component having a degrading action which is reinforceable by being energetically irradiated, the microcapsules being exposed to the energetic irradiation during the application of the separating agent layer to a respective sheet.

With a view to the structural makeup of a separating agent layer according to the invention, a further preferred feature calls for the separating agent particles to be in the form of microcapsules, the respective microcapsules having a capsule envelope formed of the separating agent substance, the respective capsule envelopes being filled with a fluid which is free of a degrading mixture component and, during the application of the separating agent layer to a respective sheet, the microcapsules are exposed to moistening by means of the vehicle liquid mixed with at least one degrading mixture component.

Also with reference to the structural makeup of a separating agent layer according to the invention, the first separating agent particles are in the form of a granulate of a first separating agent substance, and second separating agent particles in the form of microcapsules are provided; the microcapsules, respectively, having a capsule envelope filled with a fractional amount of the vehicle liquid and formed of a second separating agent substance; the fractional amounts of vehicle liquid are mixed with at least one degrading mixture component; the at least one degrading mixture component and the first and second separating agent substances are adapted to one another so that only the first separating agent substance is degradable by means of the at least one degrading mixture component; and the layer of separating agent is at least temporarily exposed to an external force which bursts the microcapsules.

With a view to applying the layer of separating agent, the applicator has first spray nozzles and optionally second spray nozzles, the first spray nozzles applying the mixture-forming separating agent particles, and the second spray nozzles applying a moistening agent which moistens the separating agent particles.

A preferred feature of the applicator is that it includes a support roller rotating in a first rotational direction during operation, and a contact roller rotating during operation in a second direction of rotation opposite the first direction, the support roller and the contact roller being positioned against one another in a contact zone and respectively contacting one side of a respective sheet passing through the contact zone in a sheet travel direction; the first spray nozzles, on the one hand, and the second spray nozzles, on the other hand, being directed towards a common target area on one side of the respective sheet, the target area being located before the contact zone in the sheet travel direction.

In another preferred feature, the applicator includes a support roller rotating in a first rotational direction during operation, and an applicator rotating during operation in a second direction of rotation opposite the first direction, the support roller and the applicator roller being positioned against one another in a contact zone and, respectively, contacting one side of a respective sheet in the contact zone; the first spray nozzles, on the one hand, and the second spray nozzles, on the other hand, being directed towards a common target area on a free region of the jacket face of the applicator roller.

In another preferred feature, the applicator has a support roller rotating in a first direction of rotation during operation and a pair of rollers disposed parallel to the support roller, positioned against one another and rotating in opposite directions during operation; one roller of the pair of rollers is positioned against the support roller with a second direction of rotation opposite the first direction of rotation; the support roller and the one roller of the pair of rollers positioned against it, respectively, contact one side of a given sheet; the first spray nozzles, on the one hand, and the second spray nozzles, on the other hand, are directed towards a common target area on a free region of the jacket face of one of the rollers of the pair of rollers.

The invention is described in detail hereinbelow. Where functional relationships between the structural makeup and the behavior of the separating agent layer, on the one hand, and various features of the applicators, on the other hand, are described, reference is made to the drawings.

Other features which are considered as characteristic for the invention are set forth in the appended claims.

Although the invention is illustrated and described herein as embodied in an apparatus for protecting the surface of freshly printed sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

BRIEF DESCRIPTION OF THE INVENTION

FIG. 1 is a diagrammatic view of an applicator according to the invention which reinforces the degrading effect of a degrading mixture component by energetic irradiation thereof;

FIG. 2 is a diagrammatic view of an applicator wherein particle streams of separating agent emerge from first spray nozzles, and streams of moistening agent emerge from second spray nozzles, the streams of separating agent particles and of moistening agent intersect, and only the first spray nozzles are directed towards the respective sheets; and FIGS. 3 to 7 are diagrammatic side elevational views of different embodiments of the invention for integrating an applicator into a printing press, wherein a respective spray stream emerging from a first spray nozzle and a respective spray stream emerging from a second spray nozzle are directed towards a common target.

DESCRIPTION OF THE PREFERRED EMBODIMENTS

As is already apparent from the description of preferred features, the scope of the invention extends to a number of possible variations in the formation of the mixture utilized for the layer of separating agent, as well as for the structural make-up of the separating-agent layer and for applicators therefor.

Figure 1:
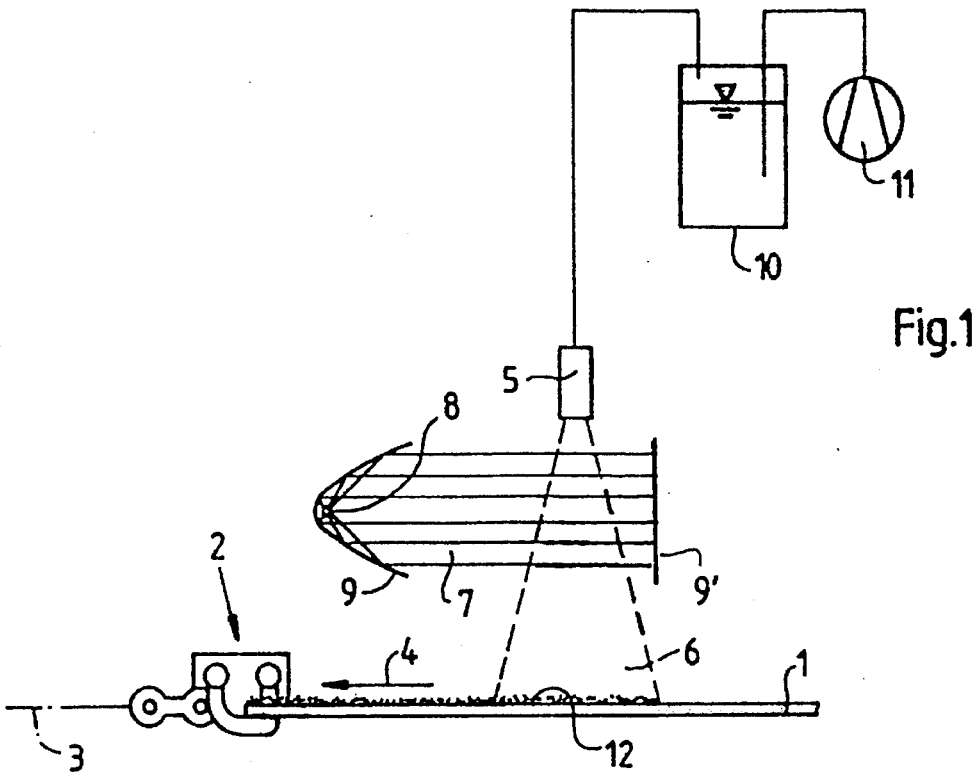

Referring now to the figures of the drawings and, first, more particularly, to FIG. 1 thereof, there is shown therein diagrammatically an applicator provided in particular for applying a layer of separating agent in which separating agent particles are in the form of microcapsules, a respective microcapsule having a capsule envelope formed of the separating agent substance, a respective capsule envelope filled with a fraction or component of the vehicle liquid, and the vehicle liquid being mixed with at least one degrading mixture component, the degrading action of which being reinforceable by energetic irradiation thereof. An example of a particularly suitable separating-agent substance is a mixture component belonging to the group of substances of polypeptides in the mixture representing the separating-agent layer, or a thermoplastic which is degradable by the action of microorganisms. Gelatin is preferably provided as the mixture component belonging to the substance group of polypeptides, while a substrate known by the tradename Biopol is used as the degradable thermoplastic, this substrate being disclosed in the corporate publication "Biopol—der Kunststoff aus der Natur" (Biopol—the Plastic from Nature) issued by Deutsche ICI GmbH, Frankfurt am Main, Germany. All the fractions of vehicle liquid enclosed in the microcapsules form the total amount of vehicle liquid of the mixture which forms the separating-agent layer, and this vehicle liquid is inoculated with microorganisms which degrade the capsule envelopes that are made of gelatin or the aforementioned thermoplastic substrate. The degradation is accelerated by means of the applicator sketched in FIG. 1, by means of energetic irradiation of the aforedescribed microcapsules.

With this applicator, the mixture which forms the separating agent layer is applied directly to a sheet 1. To that end, in the exemplary embodiment of FIG. 1, the sheet 1 is fastened in the vicinity of one of its edges in a gripper device 2 which, in turn, is secured to a transport chain apparatus 3, fragmentarily shown and represented by a phantom or dot-dash line, which imparts to the sheet 1 a motion in the direction of the arrow 4, oriented transversely to the aforementioned edge. Parallel to that edge of the sheet 1 are a number of spray nozzles 5 directed towards the sheet 1 and respectively directing a spray stream 6 made up of the mixture which forms the separating-agent layer at the sheet 1. A respective spray stream 6 is, for the most part, penetrated crosswise to its direction by an energy beam 7, which originates in a radiation source 8 and is directed towards the spray stream 6 by means of a suitable reflector array 9, 9'.

In the embodiment shown in FIG. 1, the separating-agent particles, which are present in the form of the filled microcapsules, already form the mixture which is applied by the spray nozzles 5 to the sheet 1 and forms the separating-agent layer thereat. A predetermined supply of this mixture is accommodated in a supply tank 10, from which, in a conventional manner (note German Patent 203 241, for example) it is delivered by compressed air and taken to the spray nozzles 5, the compressed air being taken from a compressor 11. While the sheet 1 then moves in the direction of the arrow 4, the spray streams 6 laden with the aforementioned microcapsules sweep over the surface of the sheet 1, and these microcapsules are deposited on the sheet 1 in the form of the separating-agent layer 12 once they have moved past the aforementioned energy beam 7. The separating-agent layer 12 is then subjected to a progressive change in structure, the cause of which is the aforementioned degradation of the capsule envelopes.

In the separating-agent particles used in the applicator described hereinbefore, a predetermined degrading action on the capsule envelopes already exists even before the action of the energy beam 7, so that quite long storage times for the mixture described above, used in combination with such an applicator, are not appropriate. A targeted degradation of the separating agent particles to the desired extent is completed only as a consequence of the aforementioned energetic irradiation.

In variations of this mixture, the vehicle liquid may be water or a protein-containing nutrient solution, and the microorganisms, in the case wherein the capsule envelope is formed of gelatin, can be replaced by peptide hydrolases, or perhaps supplemented with such peptide hydrolases.

Figure 2:
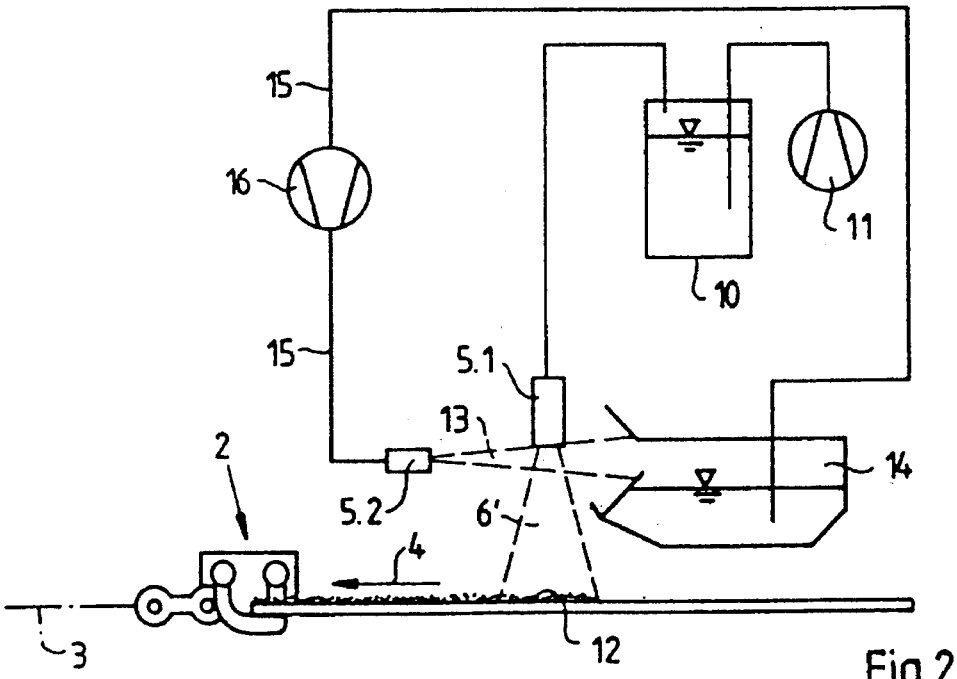

In contrast with the speedup in the aforementioned structural change in the separating-agent layer when the applicator of FIG. 1 and the aforedescribed variation in the mixture intended therefor are used, in the applicator shown in FIG. 2 and the variation in the mixture intended therefor, the structural change is initiated during the application of the separating-agent layer to the sheet 1. For that purpose, suitable variants are provided wherein the mixture representing the separating-agent layer is formed only during the application thereof to the sheet 1; the mixture components formed by the vehicle liquid and the at least one degrading mixture component are initially arranged spatially in such a manner that at least no simultaneous mutual contact occurs among all of the mixture components. The degradation of the separating-agent layer is then initiated by putting together all the mixture components which form the mixture.

The applicator suggested in FIG. 2 differs from that of FIG. 1, among other features, in that here there are first spray nozzles 5.1 and second spray nozzles 5.2 for applying the mixture; separating-agent particles being sprayed by the first spray nozzles 5.1, and a moistening agent being sprayed by the second spray nozzles 5.2. This creates the prerequisite that initially no simultaneous mutual contact occurs among all of the mixture components.

In the exemplary embodiment illustrated in FIG. 2 of an applicator operating under these conditions, a further distinction from the applicator of FIG. 1 is that the spray stream 6' emerging in this case from the respective first spray nozzle 5.1 and having the separating agent particles does not passes through an energy beam 7 (as in FIG. 1), but rather, a stream 13 of dampening agent; the dampening agent penetrating the spray stream 6' is conducted to a collecting container 14 and, from that container, is returned to the given second spray nozzle 5.2 by means of a dampening agent line 15 and a pump 16 installed therein.

Otherwise, the parts of the applicator of FIG. 2 provided with the same reference numerals as in FIG. 1 correspond to those of FIG. 1 in terms of the disposition of the parts, their function and, if desirable or necessary, the construction thereof. In particular, the spray streams 6' sweep over the surface of the sheet 1 while the sheet moves in the direction of the arrow 4 and, in the process, they deposit the mixture which forms the separating-agent layer 12. Another distinction of the apparatus of FIG. 2 over the apparatus of FIG. 1 is finally the contents of the supply container 10.

In a first possible use, the supply container 10 of the apparatus of FIG. 2 contains a mixture of separating agent particles; first separating agent particles are formed of the separating agent substance, and second separating agent particles are formed of the degrading mixture component.

In a second possible use, the supply container 10 contains mixed particles which have a core of the separating agent substance and a sheath surrounding it and made up of the degrading mixture component.

In both cases, the mixture which forms the separating-agent layer is completed by moistening the spray stream 6' emerging from the first spray nozzles 5.1 and laden with particles, with the vehicle liquid which emerges from the second spray nozzles 5.2 in the form of the moistening agent stream 13. In other possible uses of the apparatus of FIG. 2, a moistening agent stream 13 formed of the vehicle liquid and a degrading mixture component contained in it is discharged from the second spray nozzle 5.2. In this case, the supply container 10 may be filled solely with particles formed of the separating-agent substance, or with a mixture of separating-agent substance and degrading mixture component. A solvent which dissolves the separating-agent substance may also be provided as the degrading mixture component which is entrained with the stream 13 of moistening agent. In the case of gelatin as the separating-agent substance, for example, acetic acid may be provided as the solvent.

In a further possible use of the apparatus of FIG. 2, the supply container 10 is filled with separating-agent particles in the form of microcapsules, and a respective microcapsule has a capsule envelope made up of the separating-agent substance and is filled with a fluid, such as air or water, which is free of a degrading mixture component. The moistening agent stream 13 is again formed of the vehicle liquid mixed with at least one degrading mixture component.

In the case of capsule envelopes formed of a polypeptide, the moistening agent stream 13 contains not only the vehicle liquid but also the degrading mixture component in the form of enzymes belonging to the substance group of peptide hydrolases, and optionally also bacteria as enzyme suppliers, or also a solvent for the polypeptide which forms the capsule envelopes; in the case of the preferred use of gelatin to form the capsule envelope, once again acetic acid may be used as the solvent.

In a further feature of the invention, the applicator suggested in FIG. 2 is modified so that a respective spray stream 6' on the one hand and a respective moistening or dampening agent stream 13 on the other are directed towards one and the same target. Applicators modified in this manner are used in the embodiments shown in FIGS. 3 to 7 for integrating an applicator with a printing press. A respective discharge device for the mixture is shown merely diagrammatically by indicating the suitably directed first and second spray nozzles 5.1 and 5.2.

In principle, the mixture variations explained in conjunction with FIG. 2 and the structural combinations thereof may be used to operate the applicators shown in FIGS. 3 to 7; moreover, in these embodiments of the apparatus according to the invention, other possible combinations also exist which will be discussed in further detail hereinbelow.

Of various apparatus parts provided for applying the mixture which forms the separating-agent layer 12, FIGS. 3 to 7, as mentioned, show only respective first and second spray nozzles 5.1 and 5.2; the first spray nozzles 5.1 discharge separating-agent particles of a special type described hereinbelow, and the second spray nozzles 5.2 discharge a herein previously described moistening agent, and they are all disposed in such a manner that the discharged spray streams 6' and 13 are directed towards a common target.

Moreover, FIGS. 3 to 7 diagrammatically illustrate a chain delivery device which follows a printing unit in a sheet-fed rotary printing press. In the embodiments shown, a rubber blanket cylinder 17, an impression cylinder 18, and a transfer cylinder 19 are provided for a respective printing unit. Cooperating with a respective impression cylinder 18 is a delivery drum 20, around each end face of which there is an endless delivery chain 21 guided in a form-locking manner. These delivery chains 21 form the transport chain apparatus 3, mentioned hereinbefore in connection with the applicators of FIGS. 1 and 2, this transport chain apparatus 3 carrying a number of gripper devices 2 gripping a respective printed sheet 1, which was held initially on the impression cylinder 18, in the vicinity of a leading edge of the sheet and, during the motion of the transport chain apparatus 3 as indicated by the arrow 4, pull the sheet from the impression cylinder 18 and carry it to above a delivery pile 22.

The respective sheet 1 itself (note FIGS. 1 and 2) is not shown in FIGS. 3 to 7. However, it may be assumed that in these figures, it essentially coincides with the respective dot-dash or phantom line representing the delivery chain 21.

Figure 3:
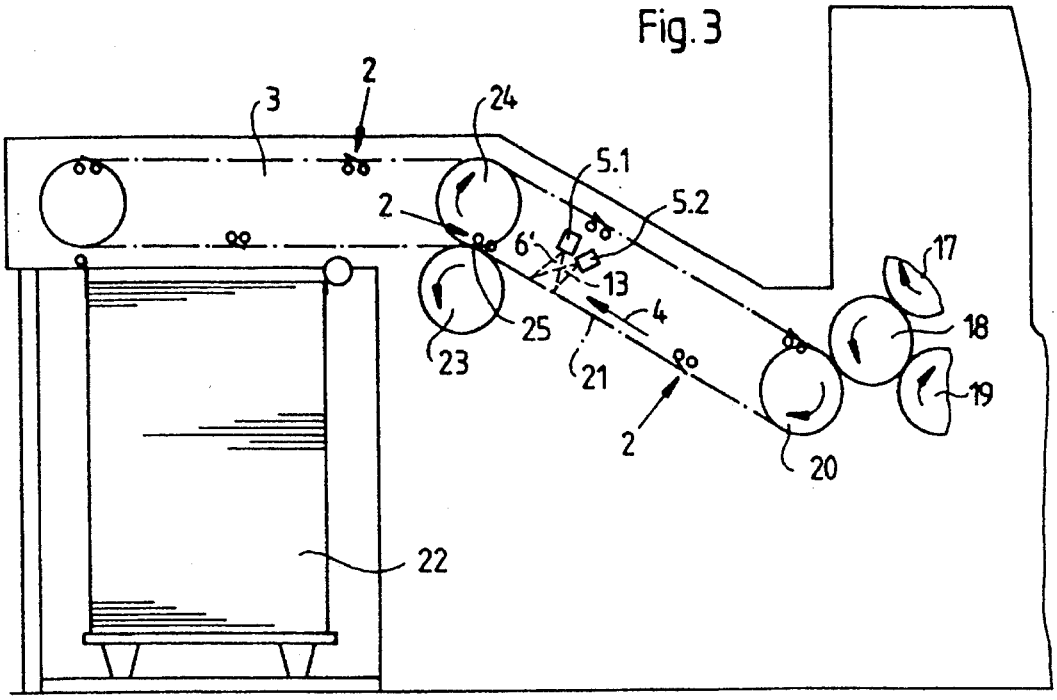

In the embodiment of FIG. 3, a respective sheet on its way from the delivery drum 20 to the delivery pile 22 initially passes through the spray streams 6' and 13, the common target of which is located on a surface of the sheet, and then move past a support roller 23 rotating in a first direction of rotation during operation, and a rotating contact roller 24 parallel thereto and rotating during operation in an opposite second rotational direction; the support roller 23 and the contact roller 24 are positioned in mutual engagement in a contact zone 25 so that they each roller 24, 25 contacts one side of the sheet.

As indicated hereinabove, the first spray nozzles 5.1 of the applicators shown in FIGS. 3 to 7 serve preferably to discharge a special type of separating-agent particles. They are formed of first separating-agent particles in the form of a granulate of a first separating-agent substance, and second separating-agent particles in the form of microcapsules; a respective microcapsule has a capsule envelope filled with a fractional amount of the vehicle liquid and including a second separating agent substance; the fractional amounts of vehicle liquid are mixed with at least one degrading mixture component; the at least one degrading mixture component and the first and second separating-agent substances are adapted to one another so that only the first separating-agent substance is degradable by the at least one degrading mixture component; and the layer of separating agent is at least temporarily exposed to an external force which bursts the microcapsules.

With respect to the first separating agent substance and the at least one degrading mixture component, recourse may be had to the combinations discussed herein in conjunction with FIGS. 1 and 2, whereas a polypeptide with high resistance to the degrading mixture component provided for degrading the first separating-agent substance, for example, is used as the second separating-agent substance.

In the applicator shown in FIG. 3, the support roller 23 and the contact roller 24 are positioned against one another so that the regions of the separating-agent layer applied to the sheet and passing through the contact zone 25 are exposed during their passage to an external force which bursts the microcapsules present in the separating-agent layer.

While the mixture preferably provided in combination with the apparatus of FIG. 2 is distinguished, among other features, in that the moistening agent stream 13 discharged by the second spray nozzles 5.2 in that apparatus contains at least one degrading mixture component, in the embodiments shown in FIGS. 3 to 7, various moistening agent streams 13 are provided, for example, formed of pure water which, in particular, is free of degrading mixture components, and which initially has the function only of improving the adhesion to a target area of the separating-agent particles sprayed onto that target area. Accordingly, in the apparatus of FIG. 3, as in those of FIGS. 4 to 7, pure water is preferably provided as the moistening agent which, once the microcapsules have been burst as a consequence of the aforementioned external force acting temporarily on the separating agent layer and originating in the mutually engaging positioning of the support roller 23 and the contact roller 24, assumes a further function, specifically that of intensively mixing the first separating-agent particles, which are present in the form of a granulate, with the content of the then-burst capsule envelopes. The intensive mutual contact, created by the fractional amounts of the vehicle liquid and the moistening agent, between the degrading mixture component initially enclosed in the capsule envelopes and the first separating-agent substance then initiates the degradation of the granulate made up of this separating-agent substance. Once degradation has occurred, given a suitable choice of geometry of the microcapsules and the volumetric proportions of granulate on the one hand and microcapsules on the other in the original separating-agent layer, then all that remains of that layer finally is a vanishingly small fraction in the form of the burst capsule envelopes.

The subject matter described thus far with reference to FIG. 3 in terms of the mixture and the initiation of the degradation of the separating-agent layer by bursting the microcapsules using an external force is equally applicable to the applicators shown in FIGS. 4 to 7, which represent variations in the constructions compared to that of FIG. 3.

Figure 4:
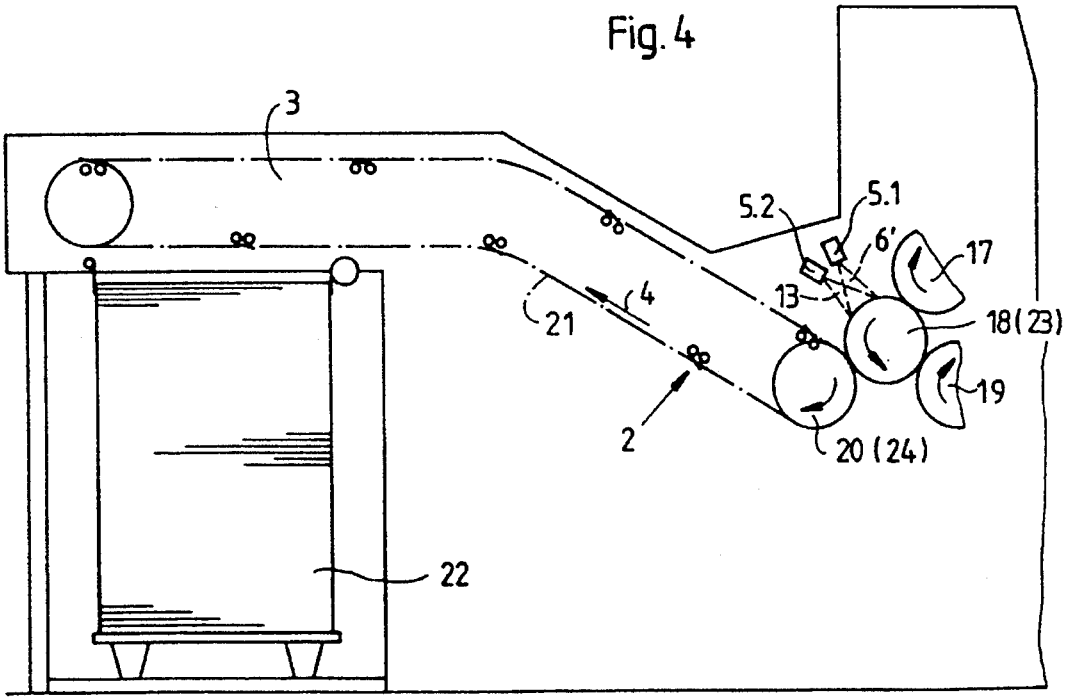

In the embodiment shown in FIG. 4, the first and second spray nozzles 5.1 and 5.2, as in the apparatus of FIG. 3, are directed towards a common target area located on the surface of a respective sheet. The disposition of these spray nozzles 5.1 and 5.2, however, is selected so that the application of the mixture to the sheet takes place while the sheet is on its way from a printing nip between a rubber blanket cylinder 17 and an impression cylinder 18 to a following delivery drum 20. The functions of a support roller 23 and a contact roller 24, explained with reference to FIG. 3, are thus additionally performed in the apparatus of FIG. 4 by the impression cylinder 18 and by the delivery drum 20 cooperating therewith.

Figure 5:
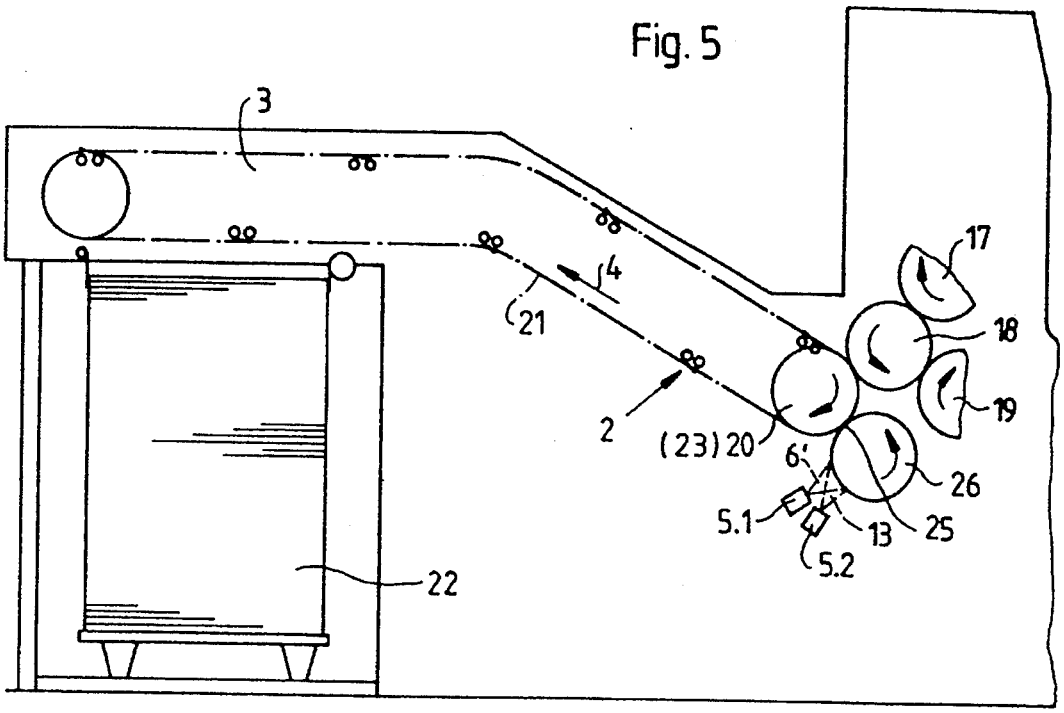
Figure 6:
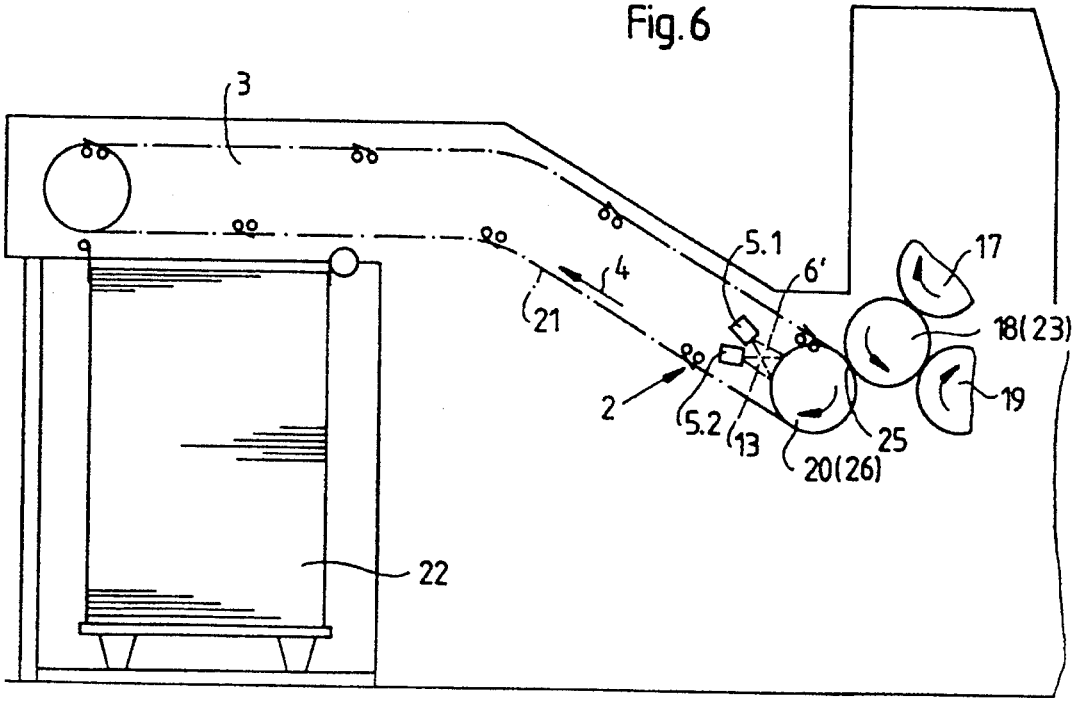
Figure 7:
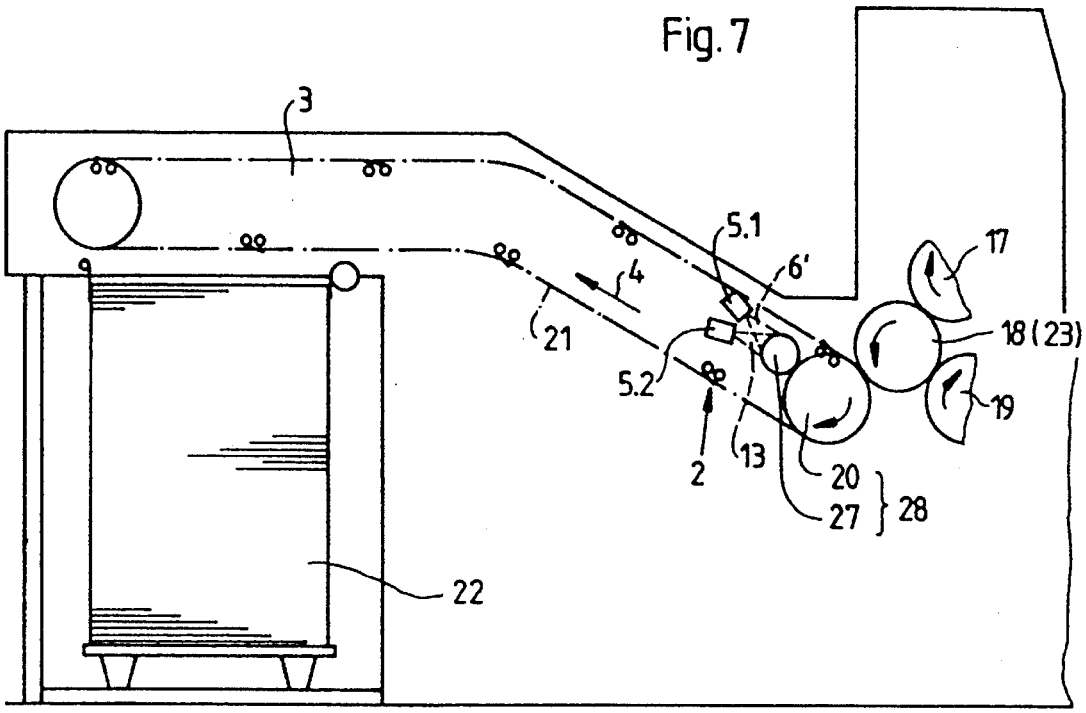

In contrast with the apparatuses of FIGS. 3 and 4, in the embodiments of FIGS. 5 to 7 the common target area towards which the spray nozzles 5.1 and 5.2 are directed is located not on a surface of a respective sheet but rather on a free region of the jacket face of an applicator roller 26, or an additional roller 27 which takes on the function of an applicator roller.

FIG. 5 shows an embodiment representing a first variant of such features. Therein, the delivery drum 20, rotating in a first rotational direction during operation, is embodied as a support roller, and an applicator roller 26 rotating parallel thereto and in an opposite rotational direction during operation is provided and positioned against the delivery drum 20 in a contact zone 25. The applicator roller 26 is positioned so that a sheet which is guided as it is supported on the delivery drum 20 by this drum is contacted by the applicator roller 26 in the contact zone 25. The aforementioned process of exploding the microcapsules by means of an external force temporarily applied to the mixture which forms the separating-agent layer then takes place in the contact zone 25 (note FIG. 5), wherein once again an application of the mixture to the given sheet guided by the delivery drum 20 takes place. In contrast with the apparatuses of FIGS. 3 and 4 and with the apparatuses described hereinbelow in conjunction with FIGS. 6 and 7, with respect to the printing nip between the rubber blanket cylinder 17 and the impression cylinder 18, a surface of the respective sheet which faces away from the rubber blanket cylinder 17 is provided with the separating-agent layer.

In the embodiment shown in FIG. 6, the delivery drum 20 additionally takes on the function of the applicator roller 27, and the function of a support roller, positioned against it in the contact zone 25, is taken on by the impression cylinder 18. The alignment of the spray nozzles 5.1 and 5.2 on a free region of the jacket face of the delivery drum 20 functioning as an applicator roller 26 is achieved by a disposition of the spray nozzles 5.1 and 5.2 within a space through which the gripper devices 2 move.

This feature is also provided in the embodiment of FIG. 7, wherein the impression cylinder 18 once again takes on the function of a support roller 23 which, during operation, rotates in a first rotational direction. The delivery drum 20 is embodied as a roller. Together with an additional roller 27, it forms a pair of rollers 28 which are parallel to the impression cylinder 18 and are positioned against one another and rotate in opposite direction during operation, and this delivery drum, as the roller of the pair of rollers 28 having a second rotational direction opposite the first rotational direction of the support roller 23 in the form of the impression cylinder 18 is positioned against this support roller 23, so that this support roller 23 and the delivery zone 20, embodied as a roller, each contact one side of a respective sheet.

As mentioned, in the embodiments shown in FIGS. 3 to 7 in combination with the special type of separating-agent particles used therein, a respective moistening agent stream 13 of pure water may be provided, which first improves the adhesion to the target area of separating-agent particles sprayed at the target area and then is involved in the mixing of the mixture components which, in the special composition of the separating agent particles, are already present in an adequate manner because of these particles, and which enter into contact with one another after the bursting of the microcapsules, so that the degradation of the separating-agent layer is begun in the manner described. Given a suitable alignment of the first spray nozzles 5.1 which discharge the aforementioned special type of separating-agent particles, it is accordingly optionally possible to dispense with a moistening agent in the form of pure water.

Apparatuses of the generic type involved, wherein the applicator has only spray nozzles 5.1 which discharge separating-agent particles of the aforementioned special type, and in which the separating agent layer is exposed at least temporarily to an external force which, given the aforementioned special type of separating-agent particles bursts the microcapsules present among these particles, are accordingly also within the scope of the invention.

The foregoing is a description corresponding in substance to German Application P 4341566.0, dated Dec. 7, 1993, the International priority of which is being claimed for the instant application, and which is hereby made part of this application. Any material discrepancies between the foregoing specification and the aforementioned corresponding German application are to be resolved in favor of the latter.

We claim:

1. Apparatus for protecting the surface of freshly printed sheets which are deposited upon one another to form a sheet pile in combination with a separating-agent layer, comprising an applicator for applying to the respective sheets said separating-agent layer formed of solid particles of separating agent, said layer of separating agent being formed of a mixture including at least one degradable separating agent substance, an aqueous vehicle liquid, and at least one mixture component which degrades the separating agent substance upon simultaneous contact with the separating agent substance and the vehicle liquid.

2. Apparatus according to claim 1, wherein said mixture includes microorganisms and a natural thermoplastic substance which is degradable under the influence of said microorganisms.

3. Apparatus according to claim 1, wherein said mixture includes a mixture component belonging to the substance group of polypeptides.

4. Apparatus according to claim 1, wherein said vehicle liquid is a nutrient solution inoculated with bacteria.

5. Apparatus according to claim 1, wherein said vehicle liquid includes a degrading mixture component in the form of a solvent which dissolves the separating agent substance.

6. Apparatus according to claim 1, wherein said mixture of said separating agent layer comprises a mixture of separating-agent particles moistened with said vehicle liquid, and first separating agent particles of said mixture of separating-agent particles formed of said separating agent substance, and second separating agent particles of said mixture of separating-agent particles formed of said degrading mixture component.

7. Apparatus according to claim 1, wherein said mixture of said separating agent layer is formed from mixed particles moistened with said vehicle liquid, and said mixed particles have a core formed of said separating agent substance and a sheath surrounding said core and formed of said degrading mixture component.

8. Apparatus according to claim 1, wherein said separating agent particles are formed as microcapsules, having a capsule envelope formed of said separating agent substance, said capsule envelopes, being filled with a fractional amount of said vehicle liquid, said vehicle liquid being mixed with at least one degrading mixture component having degrading action reinforceable by energetic irradiation of said degrading mixture component, and said microcapsules being exposed to the energetic irradiation during the application of the separating agent layer to the respective sheets.

9. Apparatus according to claim 1, wherein said separating agent particles are formed as microcapsules, and said microcapsules, have a capsule envelope formed of said separating agent substance, said capsule envelopes, being filled with a fluid which is free of a degrading mixture component and, during the application of the separating agent layer to the sheets, said microcapsules being exposed to moistening by means of said vehicle liquid mixed with at least one degrading mixture component.

10. Apparatus according to claim 1, wherein said separating agent particles include first separating agent particles in the form of a granulate of a first separating agent substance and second separating agent particles in the form of microcapsules; the microcapsules, having a capsule envelope filled with a fractional amount of said vehicle liquid and formed of a second separating agent substance; the fractional amounts of vehicle liquid being mixed with at least one degrading mixture component; said at least one degrading mixture component and said first and said second separating agent substances being adapted to one another so that only said first separating agent substance is degradable by means of said at least one degrading mixture component; and including means for exposing said layer of separating agent at least temporarily to an external force which bursts said microcapsules.

11. Apparatus according to claim 1, wherein said applicator has first spray nozzles for applying said mixture-forming separating agent particles, and second spray nozzles for applying a moistening agent for moistening said separating agent particles.

12. Apparatus according to claim 11, wherein said applicator includes a support roller rotatable in a first rotational direction during operation, and a contact roller rotatable during operation in a second direction of rotation opposite said first rotational direction, said support roller and said contact roller being positioned against one another in a contact zone contacting a respective sheet passing through said contact zone in a sheet travel direction; said first spray nozzles and said second spray nozzles being directed towards a common target area on one side of the sheet, said target area being located before said contact zone in said sheet travel direction.

13. Apparatus according to claim 11, wherein said applicator includes a support roller rotatable in a first rotational direction during operation, and an applicator roller rotatable during operation in a second direction of rotation opposite said first rotational direction, said support roller and said applicator roller being positioned against one another in a contact zone and contacting a respective sheet in said contact zone; said first spray nozzles and said second spray nozzles being directed towards a common target area on said applicator roller.

14. Apparatus according to claim 11, wherein said applicator has a support roller rotatable in a first direction of rotation during operation and a pair of rollers, extending parallel to said support roller, positioned against one another and rotatable in opposite directions during operation; one roller of said pair of rollers being positioned against said support roller and having a second direction of rotation opposite that of said first direction of rotation; said support roller and said one roller of said pair of rollers which is positioned against said support roller, respectively, contacting one side of a sheet; said first spray nozzles and said second spray nozzles being directed towards a common target area on a free region of one of said rollers of said pair of rollers.

15. Apparatus for protecting the surface of freshly printed sheets which are deposited upon one another to form a sheet pile in combination with a separating-agent layer, comprising an applicator for applying to the respective sheets said separating-agent layer said separating-agent layer comprising solid particles in the form of microcapsules; said microcapsules having a colorless capsule envelope formed of a polypeptide filled with a colorless fluid which is inert with respect to the polypeptide.

* * * * *

UNITED STATES PATENT AND TRADEMARK OFFICE

CERTIFICATE OF CORRECTION

PATENT NO. : 5,535,676
DATED : July 16, 1996
INVENTOR(S) : Buschulte et al

It is certified that error appears in the above-indentified patent and that said Letters Patent is hereby corrected as shown below:

On the title page, item 75, in the first line change "Schönboro" to -- Schönborn--.

Signed and Sealed this

Twelfth Day of November, 1996

Bruce Lehman

*Attest:*

BRUCE LEHMAN

*Attesting Officer*

*Commissioner of Patents and Trademarks*